US005890405A

United States Patent [19]

Becker

[11] Patent Number: 5,890,405

[45] Date of Patent: Apr. 6, 1999

[54] AUTOMATED SCREW DRIVING DEVICE

[76] Inventor: Burkhard Becker, 134 Meridian Blvd., Kirkland, Québec, Canada, H9H 4A4

[21] Appl. No.: 717,603

[22] Filed: Sep. 23, 1996

Related U.S. Application Data

[60] Provisional application No. 60/025,726 Sep. 11, 1996.

[51] Int. Cl.[6] ..... B25B 23/06

[52] U.S. Cl. ..... 81/434

[58] Field of Search ..... 81/57.37, 433, 81/434, 435; 227/120, 136

[56] References Cited

U.S. PATENT DOCUMENTS

| | | | |
|---|---|---|---|
| 2,973,021 | 2/1961 | Crossen . | |
| 4,014,488 | 3/1977 | Potucek et al. . | |
| 4,517,863 | 5/1985 | Ishikawa . | |
| 4,581,964 | 4/1986 | Takatsuru | 81/434 X |
| 4,774,863 | 10/1988 | Geist . | |
| 5,027,679 | 7/1991 | Kawashima et al. . | |
| 5,101,697 | 4/1992 | Fishback . | |
| 5,109,738 | 5/1992 | Farian et al. . | |
| 5,144,870 | 9/1992 | Nick . | |
| 5,154,242 | 10/1992 | Soshin et al. . | |
| 5,167,174 | 12/1992 | Fujiyama et al. . | |
| 5,186,085 | 2/1993 | Monacelli . | |
| 5,231,902 | 8/1993 | Uno et al. | 81/57.37 X |
| 5,303,620 | 4/1994 | Payne et al. . | |
| 5,337,636 | 8/1994 | Shea . | |
| 5,339,713 | 8/1994 | Hou . | |
| 5,341,706 | 8/1994 | Takagi . | |
| 5,433,129 | 7/1995 | Reusch et al. . | |
| 5,452,630 | 9/1995 | Haas et al. . | |
| 5,469,767 | 11/1995 | Habermehl . | |
| 5,522,687 | 6/1996 | Chen . | |
| 5,531,142 | 7/1996 | Adamo . | |
| 5,542,323 | 8/1996 | Habermehl et al. . | |

FOREIGN PATENT DOCUMENTS

| | | |
|---|---|---|
| 0 134 164 A1 | 3/1985 | European Pat. Off. . |
| 0 249 659 A2 | 12/1987 | European Pat. Off. . |
| 0 285 815 A1 | 10/1988 | European Pat. Off. . |
| 0 386 950 A1 | 9/1990 | European Pat. Off. . |
| 0 565 302 A2 | 10/1993 | European Pat. Off. . |
| 2 236 697 | 2/1974 | Germany . |
| 33 33 427 A1 | 4/1985 | Germany . |
| 39 30 999 A1 | 3/1991 | Germany . |
| 43 01 858 A1 | 7/1994 | Germany . |
| 2 244 445 | 4/1991 | United Kingdom . |
| 2 278 078 | 11/1994 | United Kingdom . |
| WO 93/09918 | 5/1993 | WIPO . |

OTHER PUBLICATIONS

Patent Abstracts of Japan, vol. 9, No. 297, (M–432) 25 Nov. 1985; JP 60 135142 A (Miyayama Gijutsu Kenkyusho K.K.), 18 Jul. 1985.

Patent Abstracts of Japan, vol. 9, No. 172, (M–397) 17 Jul. 1985; JP 60 044237 A (Toyoda Koki K.K.).

Patent Abstracts of Japan, vol. 96, No. 2, 29 Feb. 1996; JP 07 266246 A (Max Co. Ltd), 17 Oct. 1995.

*Primary Examiner*—D. S. Meislin
*Attorney, Agent, or Firm*—Swabey Ogilvy Renault

[57] ABSTRACT

A fully automated hand held screw driving device comprises an automatic feeding mechanism of screws to the screwdriver from an integral storage magazine, an automatic speed control mechanism for controlling the rotary speed of the screwdriver, an automatic force control mechanism for controlling the seating force of the screwdriver bit on the screw, an adjustable depth control mechanism for controlling the final screw depth in the work surface, and an adjustable seating torque control mechanism for controlling the final screw head seating torque. The screws are spirally wound on a replaceable bobbin removably mounted in the magazine. The device can accommodate a full range of practical screw sizes and can be fitted with exchangeable bits for use with screws having standard recessed star or square heads and various bolt heads. A central microprocessor is used to control all operating functions of the screw driving device.

20 Claims, 15 Drawing Sheets

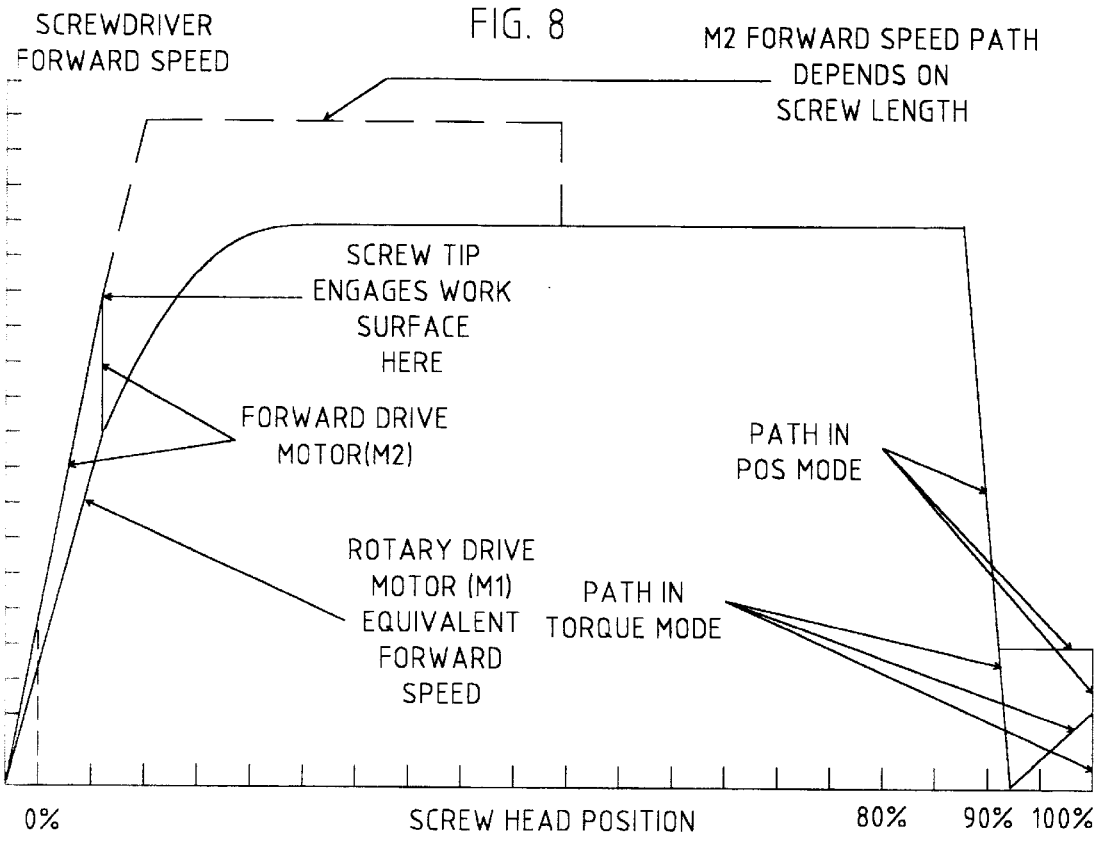
FIG. 8
SCREWDRIVER FORWARD SPEED
M2 FORWARD SPEED PATH DEPENDS ON SCREW LENGTH
SCREW TIP ENGAGES WORK SURFACE HERE
FORWARD DRIVE MOTOR(M2)
PATH IN POS MODE
ROTARY DRIVE MOTOR (M1) EQUIVALENT FORWARD SPEED
PATH IN TORQUE MODE
0%
SCREW HEAD POSITION
80%
90%
100%

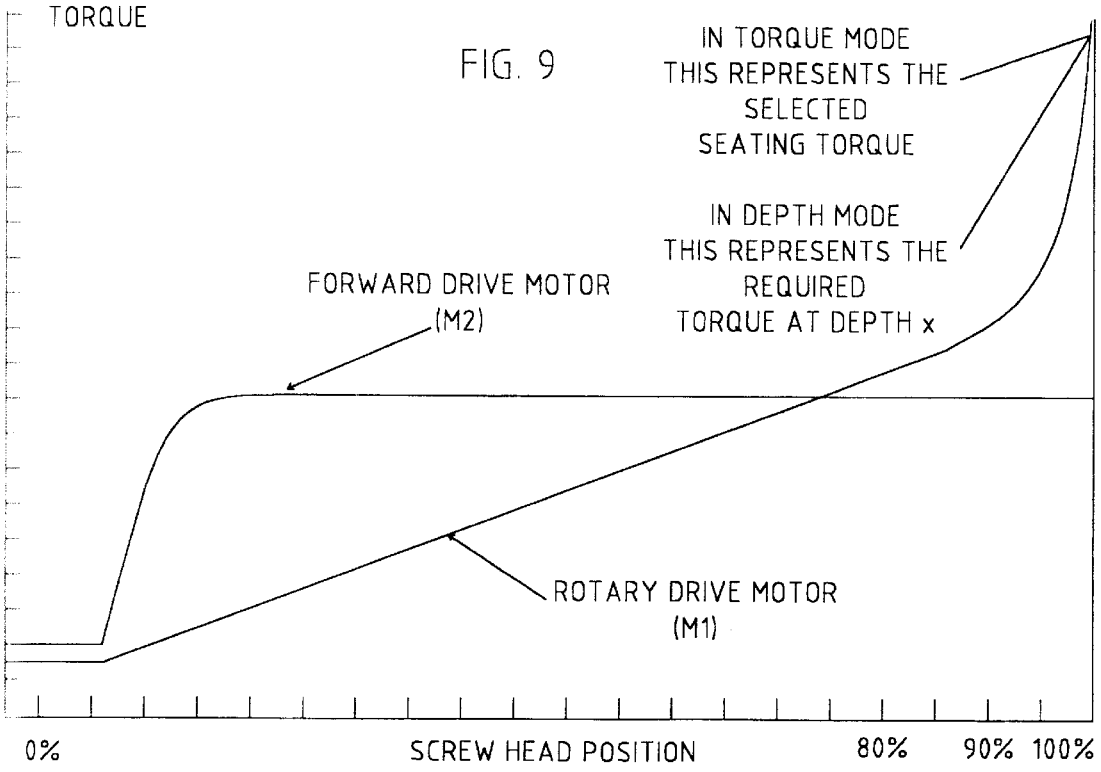
TORQUE
FIG. 9
IN TORQUE MODE THIS REPRESENTS THE SELECTED SEATING TORQUE
IN DEPTH MODE THIS REPRESENTS THE REQUIRED TORQUE AT DEPTH x
FORWARD DRIVE MOTOR (M2)
ROTARY DRIVE MOTOR (M1)
0%
SCREW HEAD POSITION
80%
90%
100%

AUTOMATED SCREW DRIVING DEVICE

RELATED APPLICATIONS

This application claims priority on U.S. Provisional Application No. 60/025,726 filed on Sep. 11, 1996 (now abandoned).

BACKGROUND OF THE INVENTION

1. Field of the Invention

The present invention relates to hand held electric screwdrivers and, more particularly, to a screw driving device for driving screws, of varying head configurations and sizes, into work surfaces in a fully automatic and controlled manner.

2. Description of the Prior Art

The process of fastening sheet construction materials is generally achieved using hand held electrical screw guns which are manually fed with screws, one by one. Current proposals to improve this procedure through partial automation generally utilize a manually operated ratchetting mechanism to feed screws, attached in series to a belt, into position in front of a screwdriver bit. The screwdriver is then actuated and manually pushed forward to engage the screw and drive it into the work surface. U.S. Pat. No. 5,109,738 issued on May 5, 1992 to Marian et al. and U.S. Pat. No. 5,167,174 issued on Dec. 1, 1992 to Fujiyama et al. both describe such belt fed screw driving machines. U.S. Pat. No. 5,154,242 issued on Oct. 13, 1992 to Soshin et al. describes a manually fed screwdriver with a multi-stage tightening torque control. This screwdriver allows for a high speed screw driving phase and a slow speed final tightening phase; it also controls torque by monitoring motor temperature to correct for variations in the magnetic characteristic of the motor due to temperature variations. All control functions in the machine are microprocessor based.

SUMMARY OF THE INVENTION

It is therefore an aim of the present invention to provide an improved screw driving device.

It is also an aim of the present invention to provide a fully automated electric hand held screw driving device.

It is a further aim of the present invention to provide a screw driving device comprising a mechanism for feeding a screw from a storage magazine to a location opposite the screwdriver bit, a mechanism which causes the screwdriver bit to engage the head of the screw which is then rotatably driven by a motor into the working surface.

It is a still further aim of the present invention to provide a screw driving device further comprising an automatic speed control mechanism for controlling the rotary speed of the screwdriver, an automatic force control mechanism for controlling the seating force of the screwdriver bit on the screw, an adjustable depth control mechanism for controlling the final screw depth in the work surface, and an adjustable seating torque control mechanism for controlling the final screw head seating torque.

It is a still further aim of the present invention to provide a screw driving device adapted to engage a full range of practical screw sizes and to be fitted with exchangeable bits for use with screws having standard recessed star or square heads and various bolt heads.

It is a still further aim of the present invention to provide a screw driving device comprising a central microprocessor to control all operating functions of the screw driving device.

Therefore, in accordance with the present invention, there is provided a screw driving device for driving screws into work pieces, comprising housing means, magazine means adapted to carry a plurality of screws, a screwdriver bit in said housing means, first motorized displacement means for positioning one of the screws opposite said screwdriver bit in an operational position of the screw, second motorized displacement means for rotatably driving said screwdriver bit, third motorized displacement means for translationally displacing said screwdriver bit between a screw driving position and at least one retracted position and coaxially to the screw in said operational position, drill switch means adapted when actuated to cause, in synchronization, said first displacement means to bring a screw to said operational position, said third displacement means to displace said screwdriver bit into engagement with the screw, and said second displacement means to rotate said screwdriver bit and thus the screw while said third displacement means progressively advances the rotating screw such that it engages a work piece.

Also in accordance with the present invention, there is provided a method for driving screws into work pieces using a screw driving device having a housing containing a translationally and rotatably displaceable screwdriver bit and a plurality of screws, comprising the step of:

(a) with said screwdriver bit being sufficiently retracted, feeding one of the screws to a location opposite said screwdriver bit such that it extends substantially coaxially therewith;

(b) displacing translationally said screwdriver bit towards the screw and into engagement therewith; and (c) rotating said screwdriver bit and the screw while translationally advancing said screwdriver bit towards the work piece such that the screw engages the work piece;

wherein above steps (a), (b) and (c) take place automatically and in a synchronized manner upon actuation of a switch means.

Further in accordance with the present invention, there is provided a replaceable bobbin for use in a screw driving device, comprising a plurality of screws detachably mounted on carrier tape means and adapted to be driven by the screw driving device and to be detached thereby from said carrier tape means, said bobbin being removably installable in the screw driving device and including spindle means and at least one flange means, said screws extending substantially perpendicularly to said carrier tape means and in a substantially parallel and successive manner therealong with said carrier tape means being spirally wound around said spindle means.

Still further in accordance with the present invention, there is provided a screw driving device for driving screws into work pieces, comprising housing means adapted to carry a plurality of screws detachably mounted on a screw carrier tape means, said screw carrier tape means defining index notch means, a screwdriver bit in said housing means which is rotatable for driving the screws one-by-one into work pieces, displacement means for positioning one of the screws opposite said screwdriver bit in an operational position of the screw such that said screwdriver bit can then be engaged to the screw, said displacement means comprising motorized rotatable roller means adapted to drive said screw carrier tape means and switch means for selectively operating or stopping said roller means, whereby said roller means displace said carrier tape means to bring the screw in said operational position and are stopped by signal means resulting from said switch means being actuated by said notch means.

BRIEF DESCRIPTION OF THE DRAWINGS

Having thus generally described the nature of the invention, reference will now be made to the accompanying drawings, showing by way of illustration a preferred embodiment thereof, and in which:

FIG. 8 is a graph showing the relative forward rates of travel of the screw and the screwdriver bit versus the screw head position;

FIG. 9 is a graph showing the output torque of the rotary drive motor (M1) for screw turning action and the output torque of the linear drive motor (M2) for screwdriver bit seating action versus the screw head position.

DESCRIPTION OF THE PREFERRED EMBODIMENTS

Figure 1:
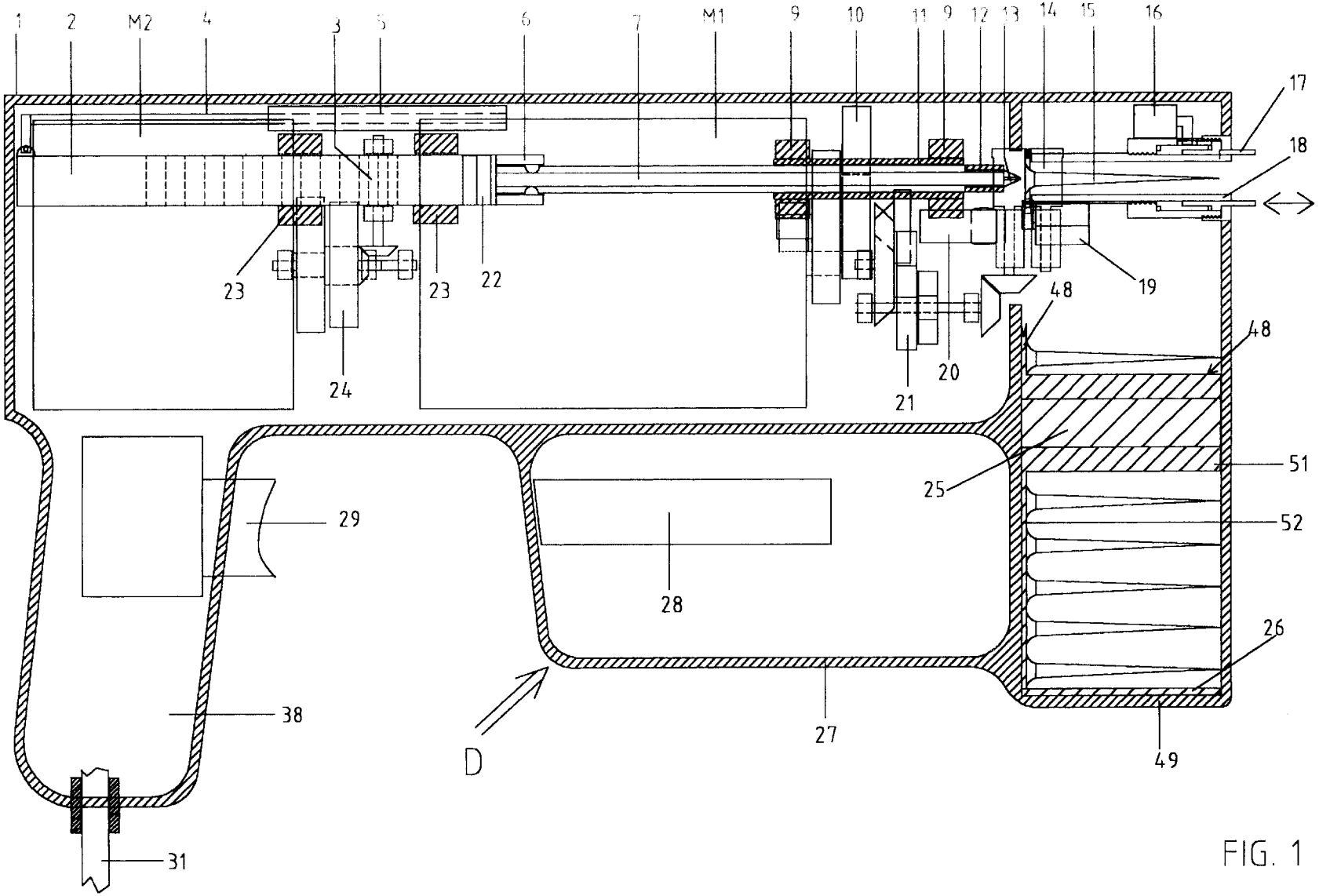
FIG. 1 is a vertical cross sectional side view of a screw driving device in accordance with a preferred embodiment of the present invention.

In accordance with the present invention, FIG. 1 illustrates a hand held fully automatic screw driving device D which should be particularly useful in the construction industry where sheet material, such as plywood, plasterboard and sheet metal are routinely fastened to large surfaces. Obviously, the screw driving device D can be used in a number of other applications where a screwdriver is required.

Before describing the present screw driving device D in details and with reference to the accompanying drawings, a general description of the present invention now follows.

The present screw driving device D provides a definite and substantial improvement over the prior art which consists of manual and electric screwdrivers and, at the upper end of the scale, of semi-automatic screw feed and automatic multi-stage screw driving control. Indeed, the screw driving device D constitutes a fully automatic apparatus which incorporates an improved screw feed mechanism, an improved multi-stage screw driving control and an automated mechanism for the forward motion and for the retraction of the rotatable and translationally displaceable screwdriver unit.

The automatic screw driving device operates in the following manner. A quantity of screws is attached to a specially designed plastic carrier tape which is spirally wound onto an expendable bobbin and housed in a hollow circular magazine integrally mounted at the front of the screwdriver. The screw carrier tape is clamped between a pair of tape drive rollers or rotating cylinders which are used to advance the tape and thus the screws to a position located opposite, i.e. in front, of the screwdriver unit of the screw driving device. Precise positioning of the screws in front of the screwdriver unit is achieved by a limit switch, mounted under the screw carrier tape, this limit switch sensing the index notches defined in the carrier tape to determine the position of the screws. The tape drive cylinders are operated by a reduction gear train, which is coupled to the main drive motor via an electric clutch.

When a screw is in position in front of the screwdriver unit, the magnetic clutch decouples the tape drive gear train from the main drive motor. When the screw driving device is held firmly against a flat surface, a safety switch operator mounted at the front face of the machine is depressed thereby allowing the screw driving action to begin when a trigger switch, which is mounted in the hand grip of the device, is also depressed. The main motor starts to rotate the screwdriver unit including the bit provided at the front end thereof. Simultaneously, a secondary motor moves the screwdriver bit translationally forward. As the screwdriver bit moves forward, it forces the screw out of the carrier tape and into a screw guide tube, the screw guide tube serving to hold the carrier tape in place as the screw is forced out of the tape. The screw is held firmly on the screw bit by a magnetic sleeve mounted just behind the tip of the screwdriver bit.

As the screw advances and engages the work piece, the screwdriver bit is held firmly against the screw at constant force by torque control of the secondary motor via a central controller unit. A control switch setting allows the choice of either depth of penetration or maximum seating torque control to terminate the screw driving sequence. To achieve this, a precision linear potentiometer is mounted on the screwdriver unit's shaft to provide a continuous indication of screw head location to the central processor. If depth of penetration control is selected, which is suitable for materials such as wood or plasterboard, then the screw is driven to the selected depth, provided the maximum safe torque limit is not exceeded. If torque control is selected, suitable where hexagonal bolt headed screws with or without washers are used in hard materials, then as the screw head approaches the work surface, as sensed by the linear potentiometer, the screwdriver rotation is slowed to a crawl. The main screwdriver motor is switched from rotary speed control to torque control until the screw head is engaged to the work surface at a preselected torque level.

When either of the above operating modes is completed, the main motor stops its screw driving action and the secondary motor translationally withdraws the screwdriver bit to the start position. The screw carrier tape is then advanced until the next screw is in drive position. The screw driving device must then be removed from the work surface, or the hand trigger control switch must be released before the screw driving cycle can be repeated.

Screwdriver forward force and seating torque are controlled indirectly by using the basic DC motor equation:

$$T=kI_fI_a$$

where: T represents torque;

k is the motor proportionality coefficient;

$I_f$ is the motor field current; and $I_a$ is the motor armature current.

The motor proportionality coefficients for both primary and secondary motors are recalculated at each operating cycle of the screw driving device so as to compensate for temperature effects on the magnetic circuits of the armature and field. A lookup data table is then utilized to determine the exact value of $I_{71}$ $I_a$ required to achieve the selected torque accurately. All control functions in the system are implemented using feedback techniques.

Referring now specifically to FIG. 1, the screw driving device D includes a casing or shell 1 comprising therein a rack 2 in meshed engagement with a pinion 3, first and second DC motors M1 and M2, respectively, a potentiometer 5 including a sliding actuator rod 4, a coupling chuck 6 and a screwdriver bit 7 detachably engaged therein. The first DC motor M1 is adapted to impart rotary motion to the screwdriver bit 7 via a reduction gear train 10 and a drive sleeve 11. The drive sleeve 11 is mounted in bearings 9. The front end of the screwdriver bit 7 is provided with an integral tip 13 and forward seating force for the screwdriver tip 13 into the head of a screw 15 is provided by the second DC motor M2 via a reduction gear train 24 which rotatably drives the pinion 3 which itself translationally displaces the rack 2. The rack 2 is mounted in bearings 23. The rotary motion of the screwdriver bit 7 is decoupled from the forward seating force drive mechanism or rack 2 by a thrust bearing 22. The screwdriver bit 7 and the forward drive mechanism 2 are joined at the coupling chuck 6. Obviously, the screwdriver bit 7 is detachable from the chuck 6 such that it can be selectively replaced with any of a series of similar screwdriver bits which have different tips adapted for engagement with various configurations of screw heads, e.g. recessed star (i.e. "philips") or square (i.e. "robertson") heads or bolt heads, for instance of the hexagonal type. For instance, a removable door can be provided on the side wall of the casing 1 closest to the screwdriver bit 7 (see left casing wall on FIG. 2A or lower casing wall on FIG. 3) such as to allow access to the screwdriver bit 7, generally between the chuck 6 and the proximal end of the drive sleeve 11. With reference to FIG. 1, the bit 7 can thus be grasped and moved to the right, thereby disengaging it from the chuck 6 such that it can be then slid through the drive sleeve 11 and the front end of the device D (with the magazine 26 being open and the screw 15 being displaced slightly to allow the bit 7 to be pulled out of the device D). An electric cord 31 provides power to the motors M1 and M2.

The first DC motor M1 is also coupled to the tape drive mechanism 14 via an electromagnetic clutch 20 and a reduction gear train 21. The screws 15 are mounted into a plastic carrier tape 33 which is spirally wound on an expendable bobbin 48 (see FIGS. 2B and 2C) removably fitted into the storage magazine 26 and comprising a tubular spindle 51 and a circular flange 52 provided at one end of the spindle 51 and extending at right angles to a rotation axis thereof. (as best seen in FIGS. 1, 2B and 2C). The carrier tape 33 is wound spirally around the spindle 51 in such a way that the wound carrier tape 33 extends in a single plane which is perpendicular to the spindle 51 (see FIGS. 1, 2B and 2C); in fact, the carrier tape 33 and the heads of the screws 15 are located adjacent to or against the flange 52 (FIG. 2C) with the screws 15 extending substantially parallelly to the spindle 51. The spirally wound carrier tape 33 and its support bobbin 48 are mounted in the screw magazine 26 by means of a centering pin 25 engaged in spindle 51, the bobbin 48 being free to rotate around the pin 25. Access to the front part of the shell 1 of the screw driving device D is provided by a door 49 which opens outwardly by means of a hinge 32 thereby allowing for the insertion of the bobbin 48 and its screw spiral tape 33 into the screw magazine 26 (see FIG. 2C) and removal of the bobbin 48 for replacement thereof because it is empty or to change the screw type.

Figure 6:
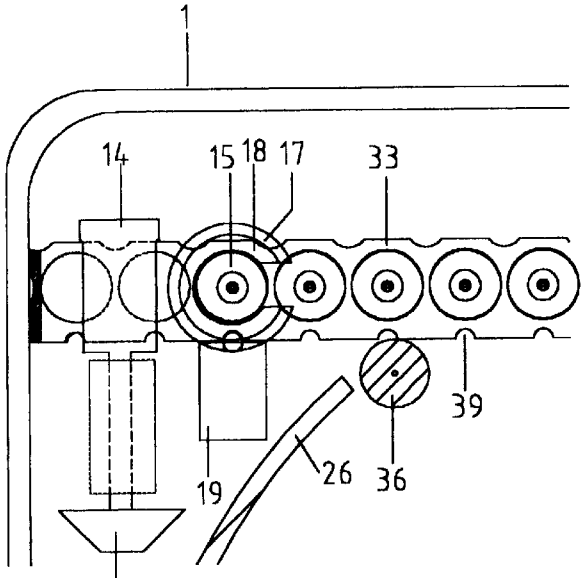
FIG. 6 is a front end view of the screwdriver bit, screw tape drive and screw guide section of FIGS. 4 and 5.

The tape drive mechanism consists of a pair of cylinders 14 oppositely mounted on each side of the screw carrier tape 33 so as to hold the tape 33 under pressure. The screw tape 33 is initially fed into the tape drive cylinders 14 by a leader tape 40 which is thinner than the screw tape 33; this allows the leader tape 40 to be inserted between the tape drive cylinders 14 and the screw tape 33 to be pulled between the cylinders 14. The screws 15 are brought into position in front of the screwdriver bit 7 and its tip 13 by rotation of the tape drive cylinders 14 with the carrier tape 33 being supported upstream of the guide tube 18 by a guide wheel 36 (FIG. 6) in order to ensure that the tape 33 is fed straight to the guide tube 18 and thus prevent it from jamming against the screw guide tube 18 (see FIG. 2B). The position of the screw 15 is detected by a limit switch 19 which senses the index notches 39 defined in the screw tape 33 (see FIG. 6). A screw guide tube 18 supported by a support 47 (see FIG. 2B) serves as a restraining mechanism for the screw tape 33 as the screw 15 is pushed out of the screw carrier tape 33 by the screwdriver bit 7. During the period when the screw 15 has been pushed out of the screw carrier tape 33 and the screw tip has not yet engaged the work surface, the screw 15 is held onto the screwdriver bit 7 by a magnetic sleeve 12. The screw-less portion of the carrier tape 33, i.e. the tape portion extending downstream of the screwdriver bit 7 and then between the rollers 14 (see FIG. 6), is received in take-up tape holding chamber 47 (see FIG. 3).

The gear trains 10, 21 and 24 are housed in hermetically sealed gearboxes (not shown) to protect their mechanisms from dirt and the like.

Figure 2A:
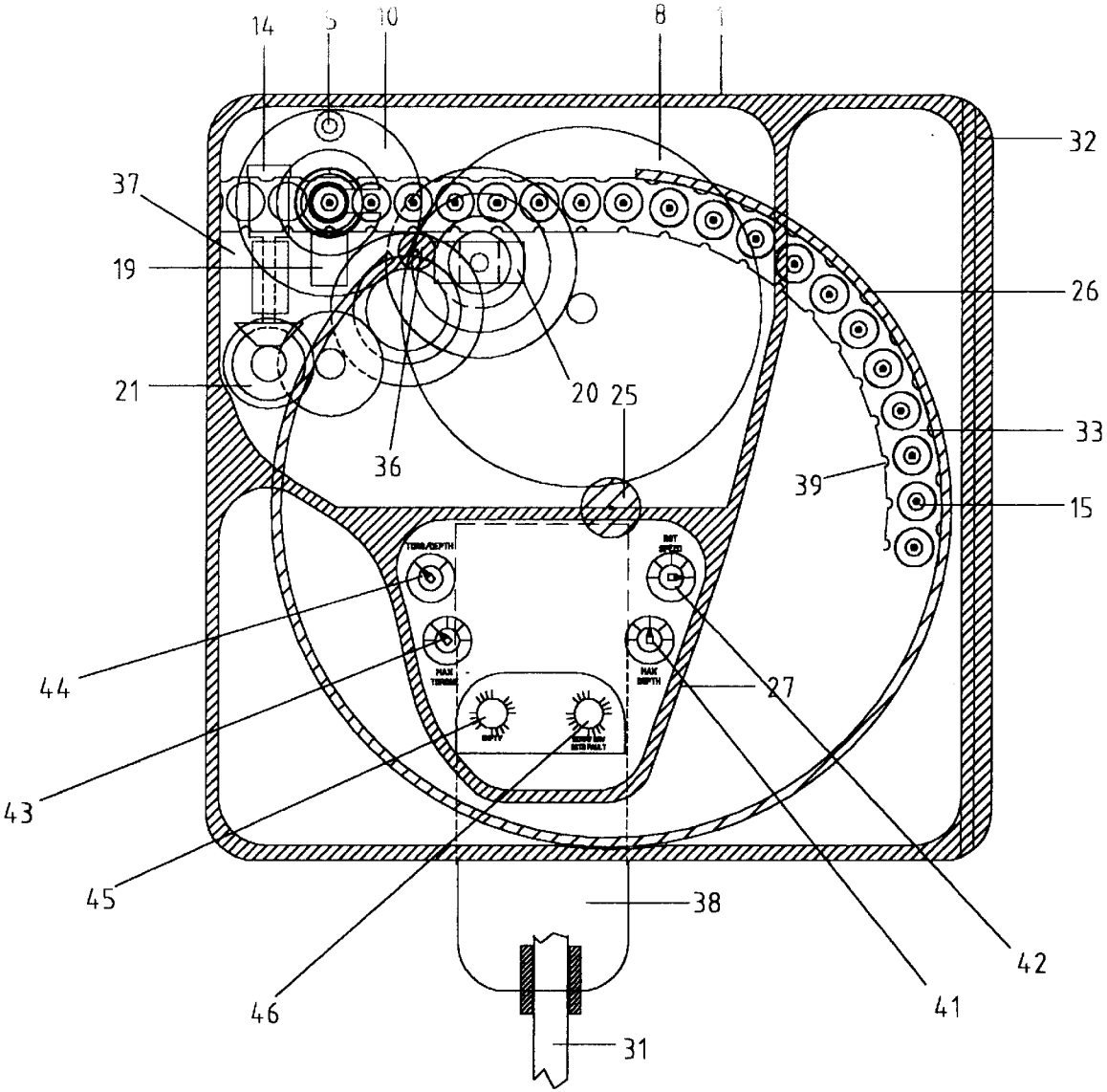
FIG. 2A is a vertical cross sectional front end view of the screw driving device.
Figure 2C:
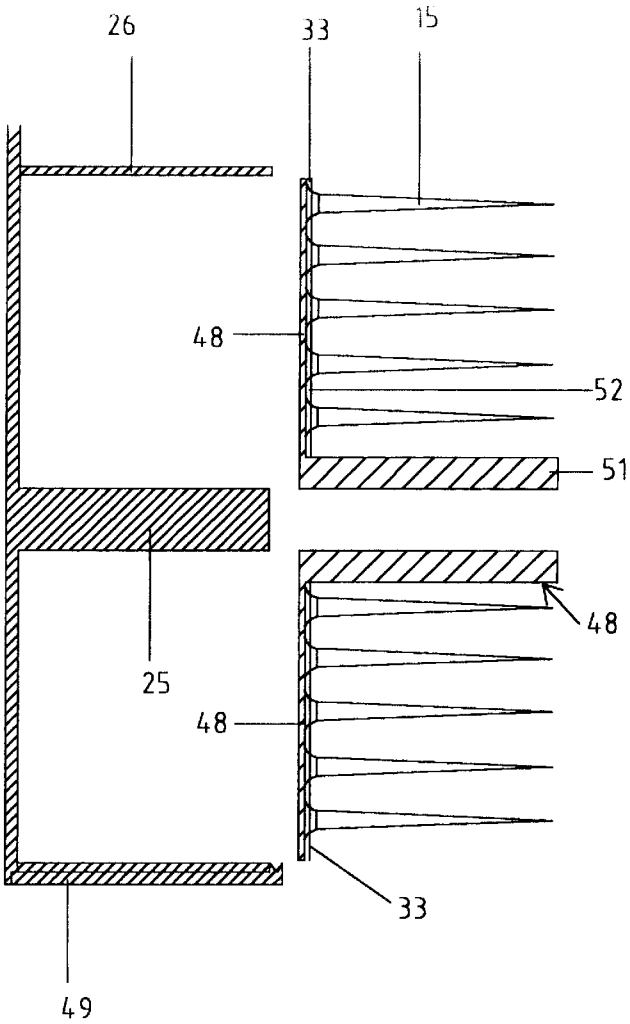
FIG. 2C is a schematic cross sectional exploded side view of the magazine.
Figure 2B:
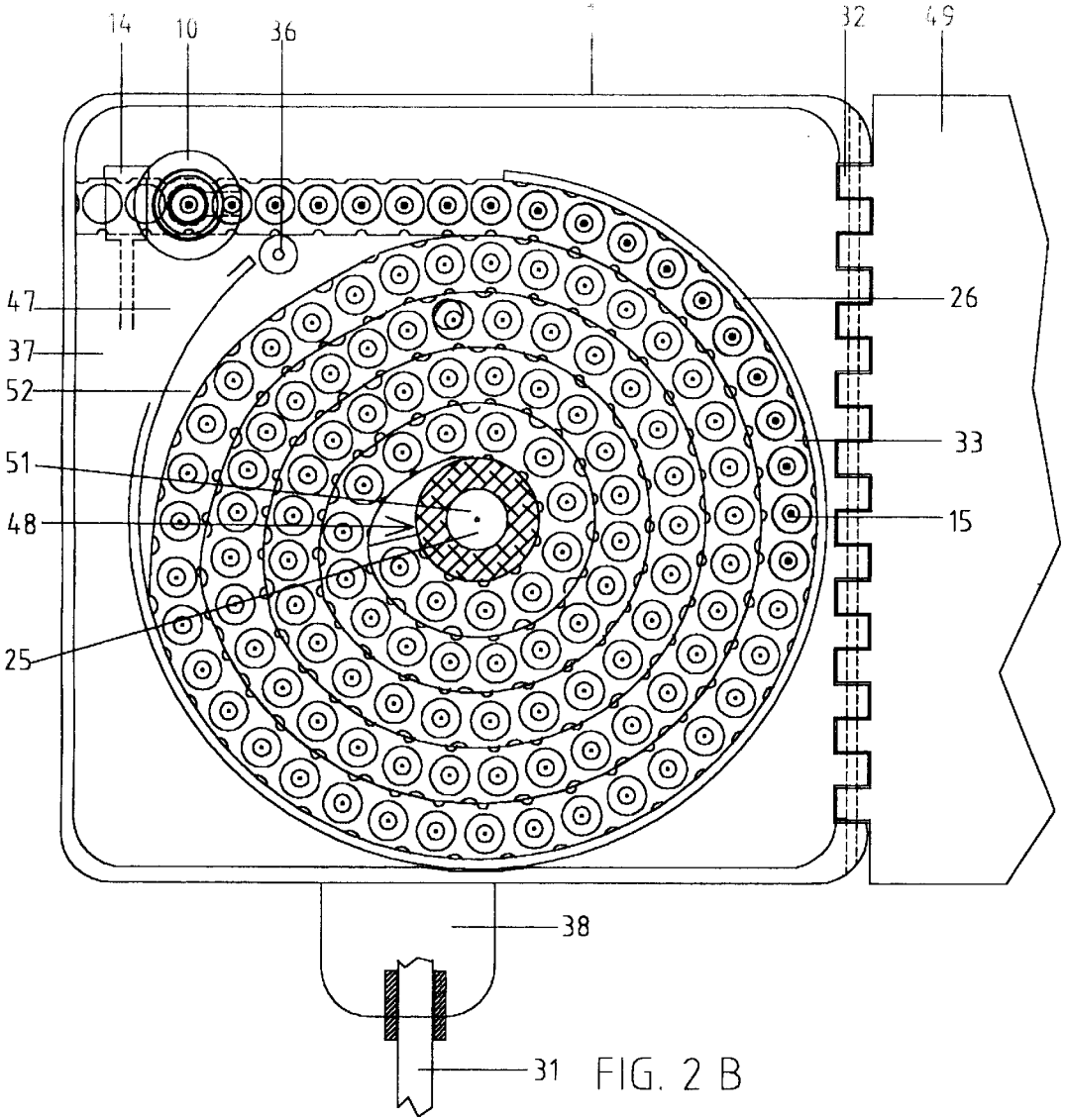
FIG. 2B is a schematic front end view of the storage magazine of the screw driving device shown in an open position thereof.
Figure 3:
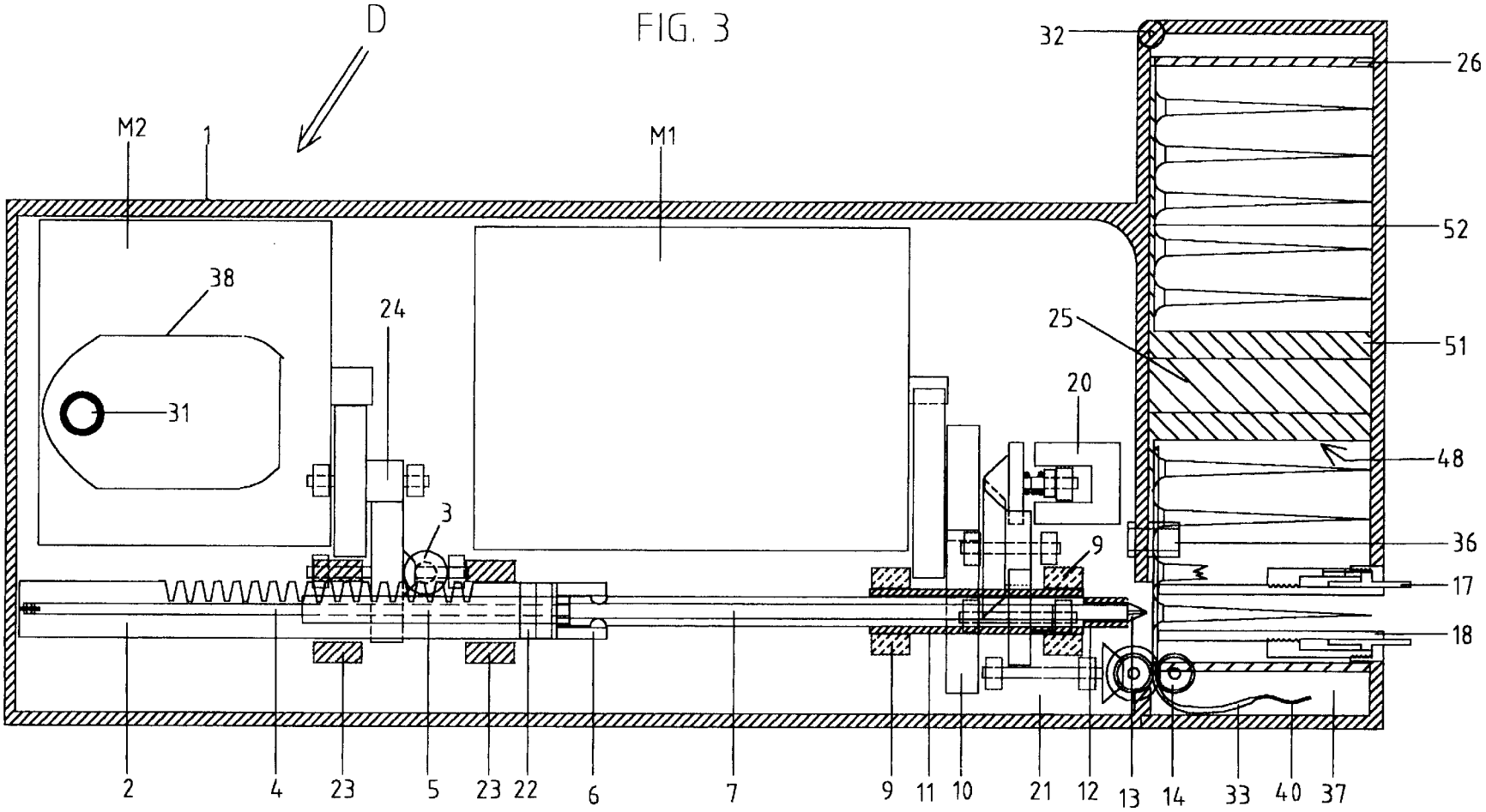
FIG. 3 is a horizontal cross sectional top plan view of the screw driving device.
Figure 4:
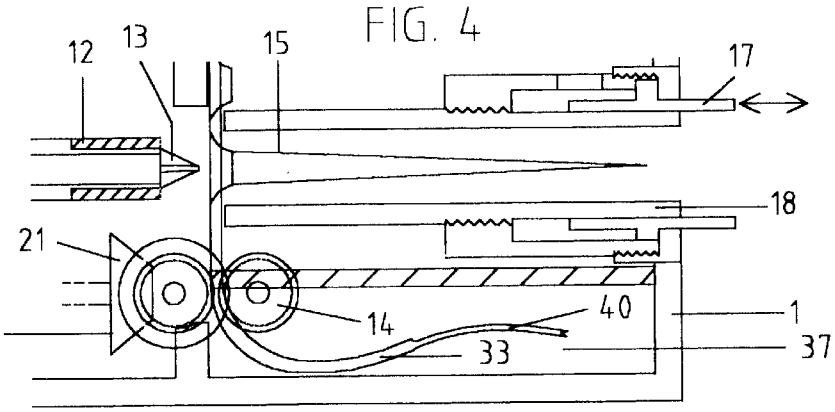
FIG. 4 is an enlarged top plan view of the screwdriver bit, screw tape drive and screw guide section of the screw driving device.
Figure 5:
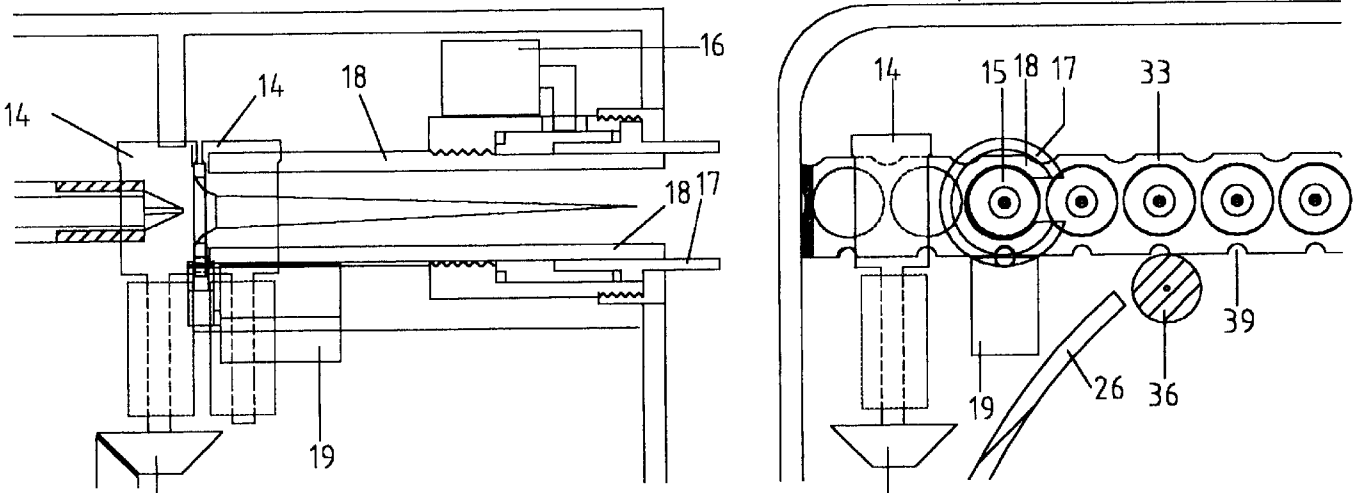
FIG. 5 is a side elevational view of the screwdriver bit, screw tape drive and screw guide section of FIG. 4.

As best seen in FIGS. 2A and 3, the screwdriver bit 7 and the screw 15 aligned therewith are located in the upper right hand corner of the casing 1, approximately ¾" or less (i.e. basically as close as possible) away from the top and right walls thereof preferably with markings on these walls, to allow screws to be inserted close to corners and to facilitate the accurate positioning of the screws on the work piece.

Figure 7:
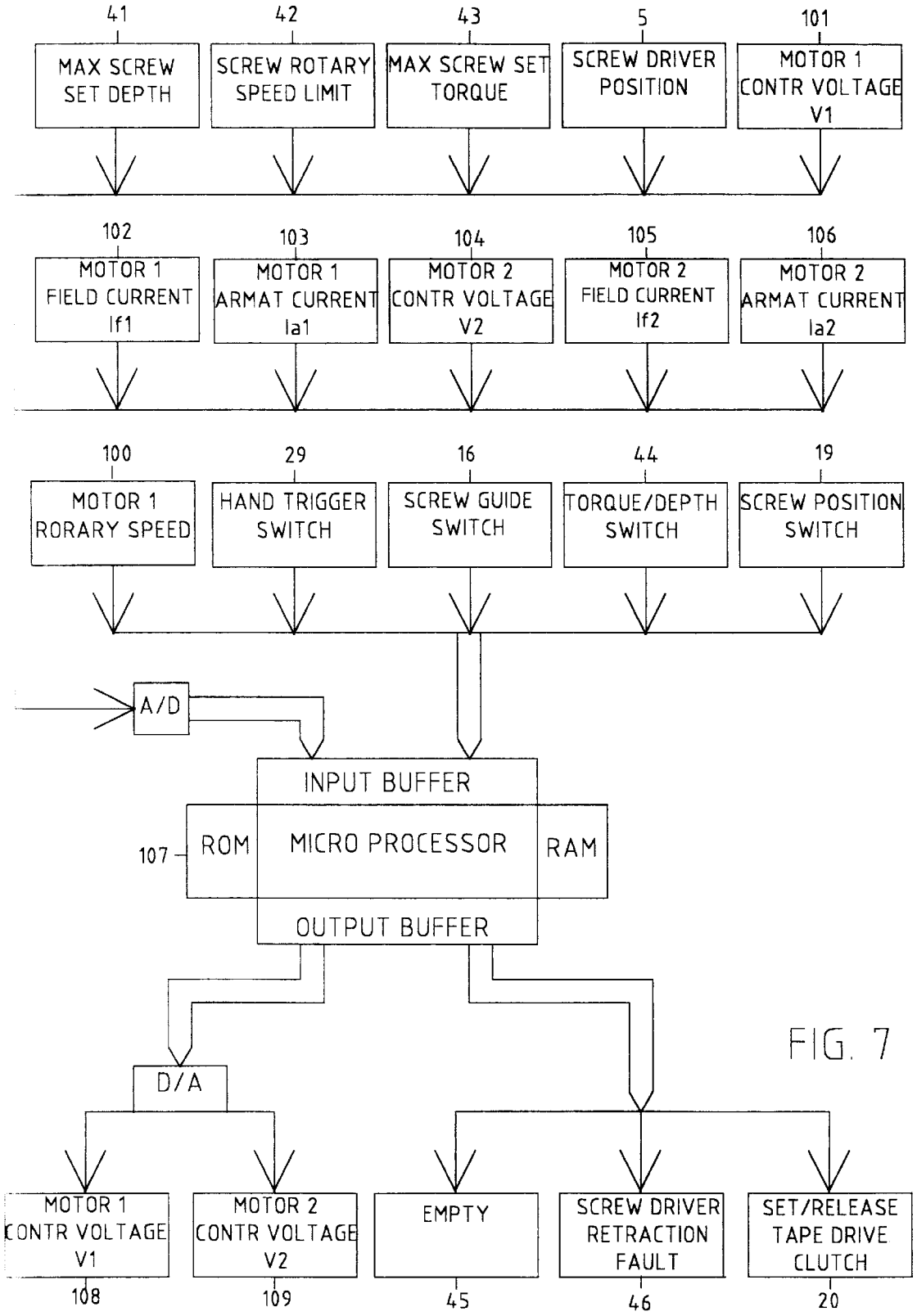
FIG. 7 is a block diagram of the control architecture of the screw driving device.

The operation of the screw driving device D is controlled by a central microprocessor 28 mounted in a hand grip 27. The architecture of the control system is shown in FIG. 7. The control system utilizes the following analog inputs.

1) the maximum screw depth which is set by knob 41, a potentiometer setting which determines the depth to which the screw head is driven into the work surface;
2) the screw rotary speed limit which is set by knob 42, a potentiometer setting which determines the maximum rotary speed of the screws 15 as they are driven into the work surface;
3) the maximum screw torque which is set by knob 43, a potentiometer setting which determines the maximum torque to which the screws 15 are tightened when torque mode is selected;
4) the position of the screwdriver bit 7, an input which is provided by the linear potentiometer 5 which continuously provides information regarding the position of the head of the screw 15 as it travels toward the work surface on the basis that the actuator rod 4 extends through the potentiometer 5 and is connected at its rear end to the rack 2 (see FIG. 1) thereby continuously providing to the potentiometer 5 the relative axial position of the rack 2 and thus of the head of the screw 15;
5) the control voltage 101 of the first motor M1 which provides a continuous reading of the voltage applied to the first motor M1;
6) the field current 102 of the first motor M1 which provides a continuous reading of the first motor M1 field current;

7) the armature current 103 of the first motor M1 which provides a continuous reading of the first motor M1 armature current;

8) the control voltage 104 of the second motor M2 which provides a continuous reading of the voltage applied to the second motor M2;

9) the field current 105 of the second motor M2 which provides a continuous reading of the second motor M2 field current; and 10) the armature current 106 of the second motor M2 which provides a continuous reading of the second motor M2 armature current.

The control system uses the following digital inputs.

1) the rotary speed 100 of the first motor M1 which is a measurement of the first motor M1 rotary speed;

2) hand trigger switch 29 provided on the handle 38 which indicates whether the hand trigger switch is in the "on" or "off" position;

3) screw guide limit switch 16 actuated by switch actuator 17 which indicates whether or not the front of the screw driving device D is firmly pressed against the work surface on the basis that, by positioning the device D against the work piece, the actuator 17 is pushed into the screw guide tube 18 such as to be flush with the front wall of the casing 1 and actuate the limit switch 16;

4) torque/depth switch 44 which selects whether the screw 15 will be driven into the work surface to a maximum selected torque or to a maximum selected depth; and 5) screw position switch 19 which indicates whether or not the screw 15 is in the drive position.

The control system uses the following analog outputs.

1) first motor M1 control voltage 108 is a variable DC voltage used to control the first motor M1; and 2) second motor M2 control voltage 109 is a variable DC voltage used to control the second motor M2.

The control system uses the following digital outputs.

1) indicator light 45 indicates that the screw magazine 26 is empty, or a fault has occurred in the screw tape transport mechanism;

2) indicator light 46, i.e. screwdriver retraction fault, indicates that the screwdriver bit 7 is not properly retracted; and 3) 50 is a control signal which acts to set or release the tape drive clutch mechanism 20.

FIGS. 10A to 10H constitute a logic flow diagram which illustrates how the screw driving device D is controlled. A normal operating sequence of the device D would proceed as follows: when electrical power is supplied to the device D, the control initiates at 120 (FIG. 10A); if the screw detection switch 19 detects a screw 15 in the drive position, the logic moves on to 121 to ensure that the screwdriver bit 7 is fully retracted; if either condition 19 or 121 does not hold true, the logic moves to the screwdriver retraction and screw positioning mode which will be described subsequently. If a screw 15 is detected in the drive position and the screwdriver bit 7 is fully retracted, the logic requires that either the hand trigger switch 29 or the screw guide limit switch 16 be switched off and on in sequence (by removing the device D sufficiently from the work piece to allow switch actuator 17 to return, under spring bias, to its extended position shown in FIGS. 1, 3, 4, and 5) so that the screw driving cycle is interrupted and the screw driving device D is moved to a new position, this logic being represented by sequence 29, 16, 16, or 16, 29, 29. If the above conditions are true, the first motor M1's starting sequence is initiated at 42 and the second motor M2's starting sequence is initiated at 43. The maximum rotary speed limit of the first motor M1 is read from the selector switch 42. At 123, the first motor M1 is started and ramped toward the maximum M1 rotary speed limit. At 43, the maximum torque limit of the second motor M2 is determined; at 124, the second motor M2 is started and the speed thereof is controlled, using feedback, with a voltage ramp so that the resulting forward motion of the screwdriver bit 7 is higher than the forward motion of a screw as determined by the current rotary speed of the first motor M1. At 125, the armature resistance of the second motor M2 is calculated from the relation:

$$R_{a2}=V_{a2}/I_{a2}$$

where: $R_{a2}$ is the M2 armature resistance;
$V_{a2}$ is the M2 armature voltage; and
$I_{a2}$ is the M2 armature current,
given that the rotary speed of the second motor M2 is very small.

Reference should be made to FIG. 8 for a further illustration of the control sequence. At 0% screw head position, the screwdriver tip 13 engages the head of the screw 15 and the screw 15 is forced out of the screw carrier tape 33. The screw tip now moves toward the work surface at a speed which is higher than the equivalent forward travel of the screw 15 due to its rotary motion. When the screw tip engages the work surface, the screw forward rate of travel of necessity slows to the equivalent rate due to the rotary speed of the screwdriver bit 7. This reduction in forward speed of the second motor M2 is detected at 127 (FIG. 10B); at 200 (FIG. 10D), the motor proportionality coefficient of the second motor M2 is recalculated from the equation:

$$k_2=(V_{a2}-I_{a2}R_{a2})/\omega_2 I_{f2}$$

where: $k_2$ is the M2 proportionality coefficient;
$V_{a2}$ is the M2 armature voltage;
$I_{a2}$ is the M2 armature current;
$R_{a2}$ is the M2 armature resistance;
$\omega_2$ is the M2 rotary speed; and
$I_{f2}$ is the M2 field current,
given that the motor control ramp rate is sufficiently small to make inductive and inertial effects minimal.

At 201, the calculated value $k_2$ is used to determine, from a look up data table stored in read only memory, the required armature-field current product for control of the torque of the second motor M2 to a maximum value and thereby the seating force of the screwdriver bit 7 onto the screw 15 to a maximum value. $I_{a2}$ and $I_{f2}$ are measured and used in a feedback control of motor torque based on the DC motor equation:

$$T_2=k_2 I_{a2} I_{f2}$$

where: $T_2$ is the M2 motor torque.

The recalculation of $k_2$ for every operating cycle of the screw driving device D allows for the dynamic compensation of the effect of temperature variations on the magnetic characteristic of the motor armature and field. This compensation procedure provides for stable and accurate control of the screwdriver bit seating force.

FIG. 9 shows the forward drive motor M2 torque versus % screw head position curve.

At 203, the M1 speed ramp is continued and at 204/205 the system pauses until the maximum M1 speed is reached.

At 44, the system branches to either the position mode or the torque mode. Assuming the position mode is selected, the following sequence occurs. At 206, the screw position is monitored, when the screw position reaches 85%, M1, rotary speed is ramped to 20% of maximum at 207, this being to slow the rotation of the screw 15 for the approach to final seated position. At 208, the screw position is monitored for 100% seated position, and when the 100% position is reached a stop sequence is initiated at 258. Time delay 209 and control sequence 210/214 serve to stop the machine if the full seated position cannot be reached.

If at 44 the torque mode is selected, the following sequence occurs. At 250, the screw position is monitored, and when the screw position reaches 80%, intermediate coefficients $C_1$ & $C_2$ are calculated for the purpose of calculating $K_1$, the M1 proportionality coefficient, later in the cycle, when $R_{a1}$ the motor armature resistance becomes available.

$$C_1=V_1/\omega_1 I_{f1} \;\&\; C_2=I_{a1}/\omega_1 I_{71\ 1}$$

where: $V_1$ is the M1 control voltage;

$\omega_1$ is the M1 rotary speed;

$I_{f1}$ is the M1 field current; and $I_{a1}$ is the M1 armature current.

At 252, the screw position is monitored until it reaches 85%; at 253, $V_1$ is ramped down to a level where M1 stalls. At 254, $R_{a1}$ is calculated from the relation:

$$R_{a1}=V_1/I_{a1}$$

where: $R_{a1}$ is the M1 armature resistance.

At 255, $k_1$ is calculated from the equation:

$$k_1=C_1-C_2R_{a1}$$

where: $k_1$ is the M1 proportionality coefficient.

M1 torque is given by the DC motor equation:

$$T_1=k_1 I_{a1} I_{f1}$$

where: $T_1$ is the M1 motor torque.

The maximum required tightening torque is read at 43 and with $k_1$ available the required $I_{a1}I_{f1}$ product is determined from a data table stored in read only memory. At 257, $V_1$ is ramped to produce the required $I_{a1}I_{f1}$ product, under feedback control, to accurately apply the maximum required tightening torque to the screw 15.

The recalculation of $k_1$ for every operating cycle of the machine allows for the dynamic compensation of the effect of temperature variations on the magnetic characteristic of the motor armature and field. This compensation procedure provides for stable and accurate control of the screwdriver seating torque.

Figure 10A:
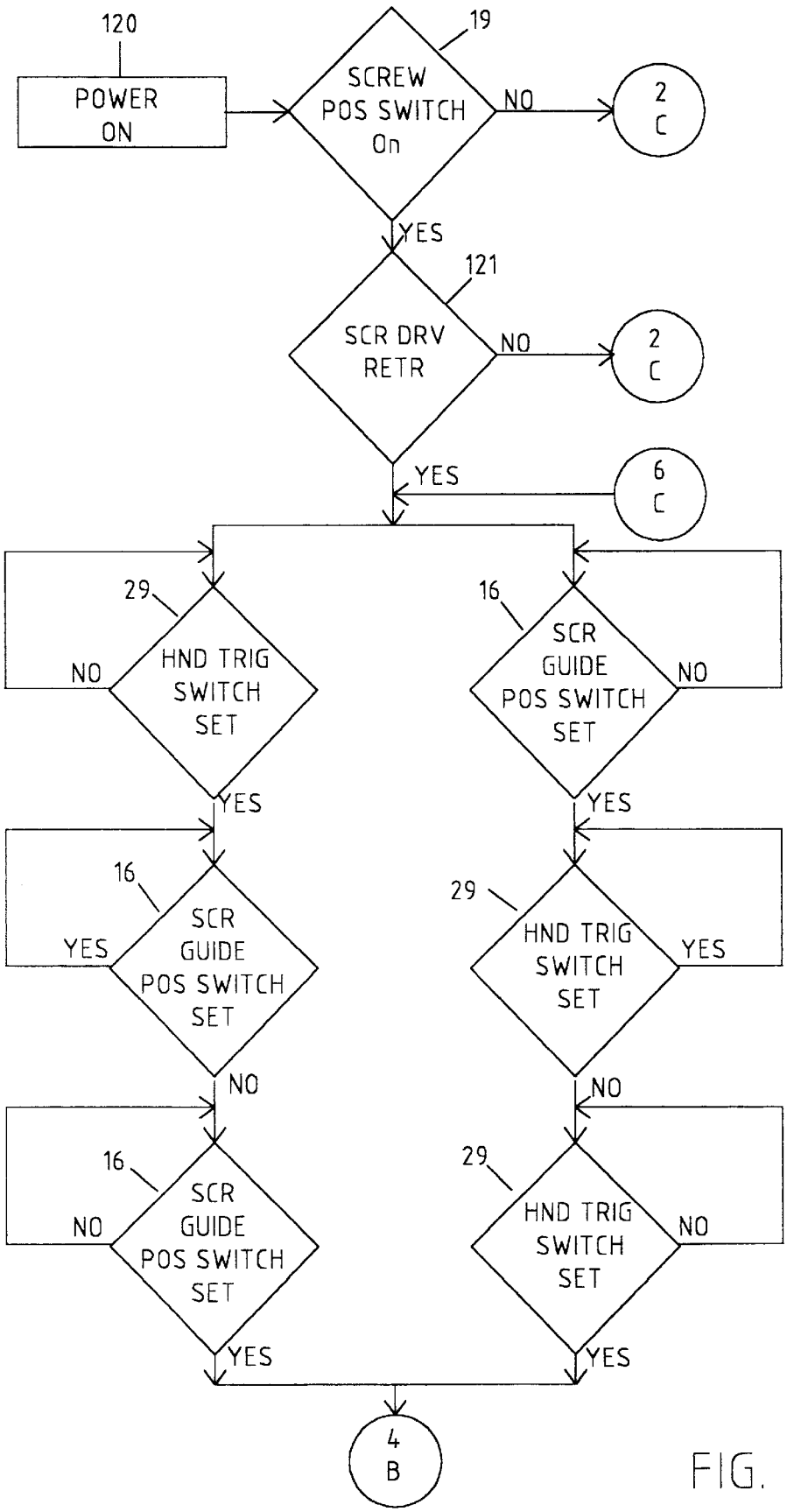
FIGS. 10A to 10H represent a logic flow diagram showing the control sequence of the power tool.
Figure 10B:
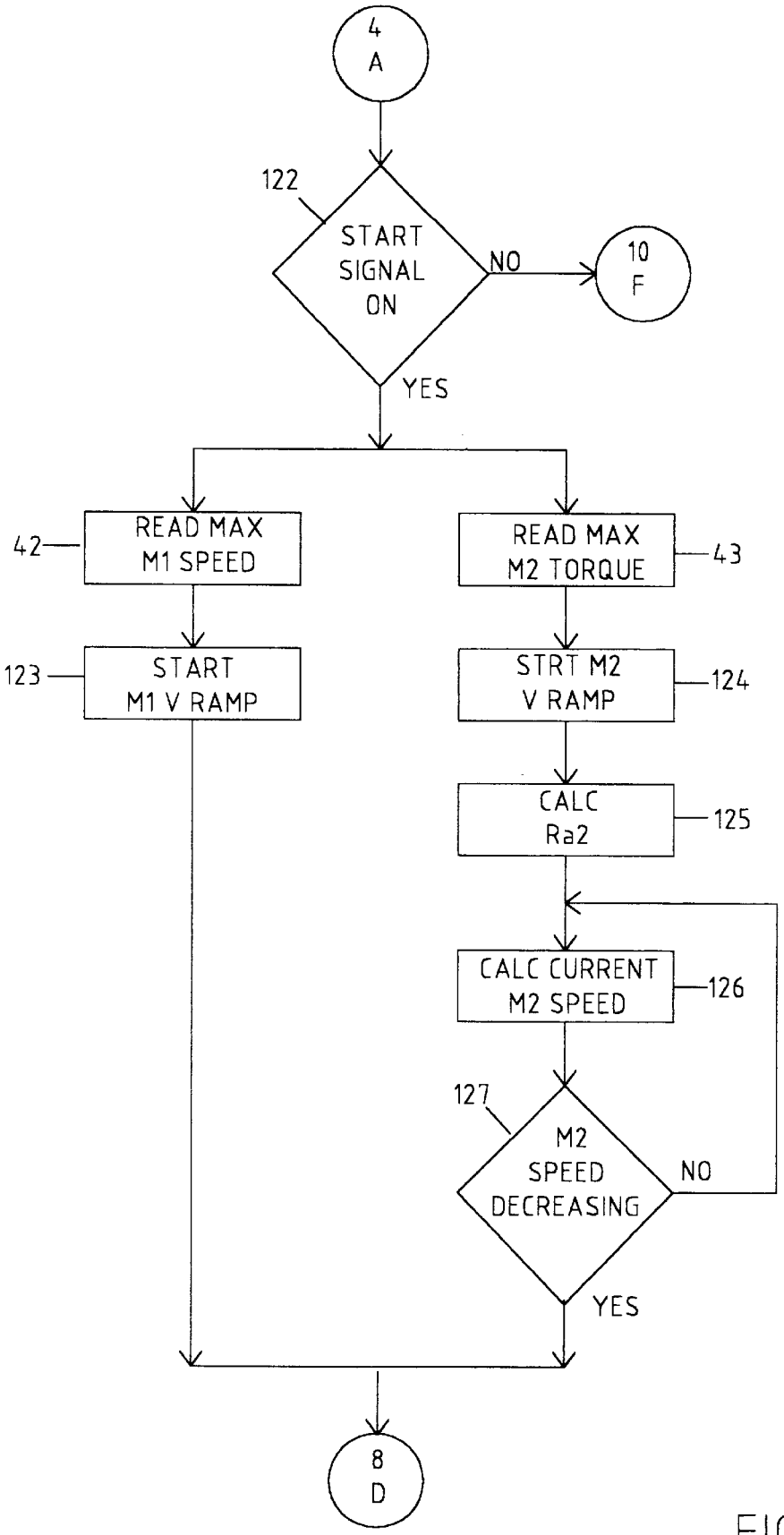
Figure 10C:
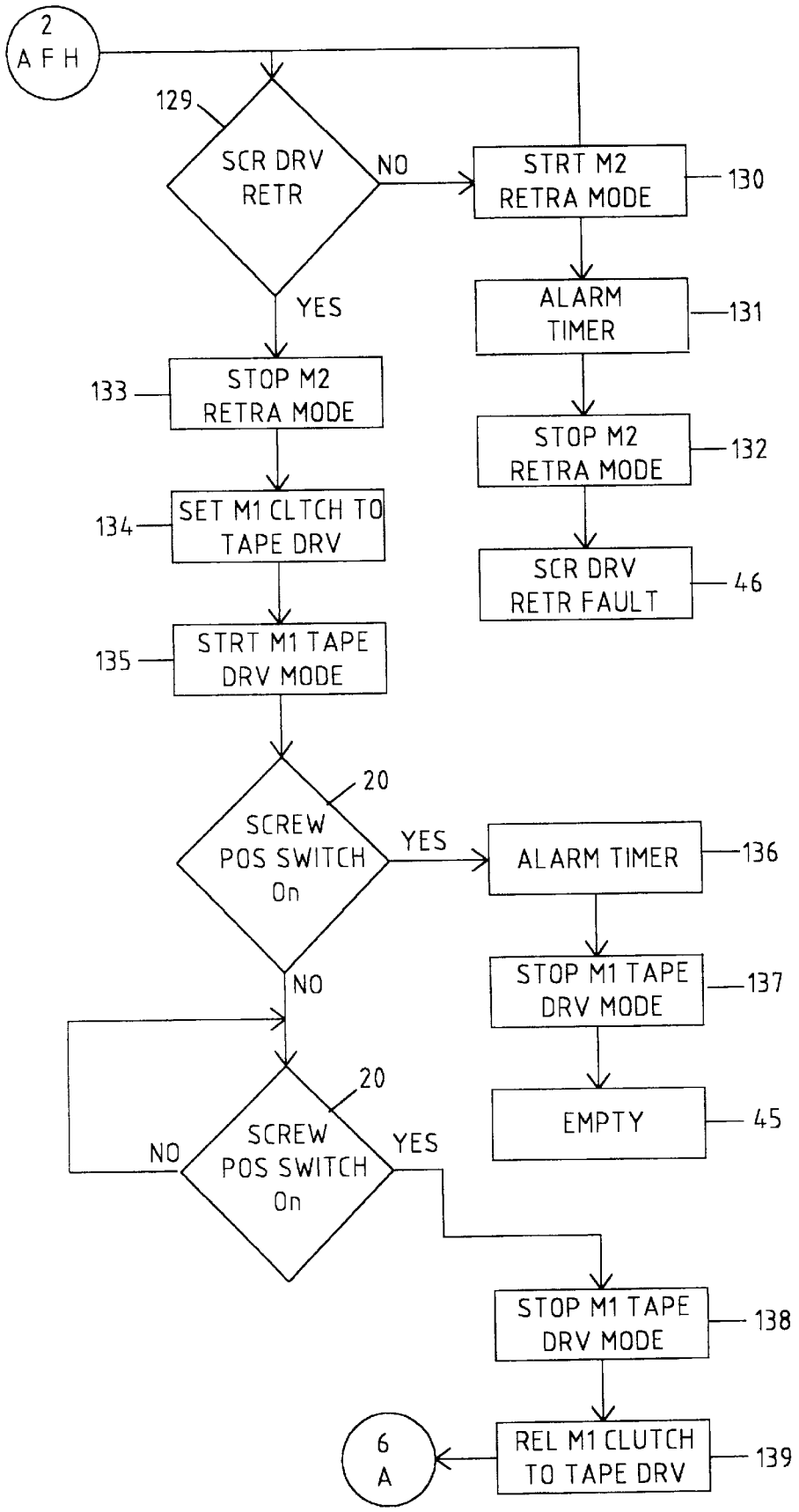
Figure 10D:
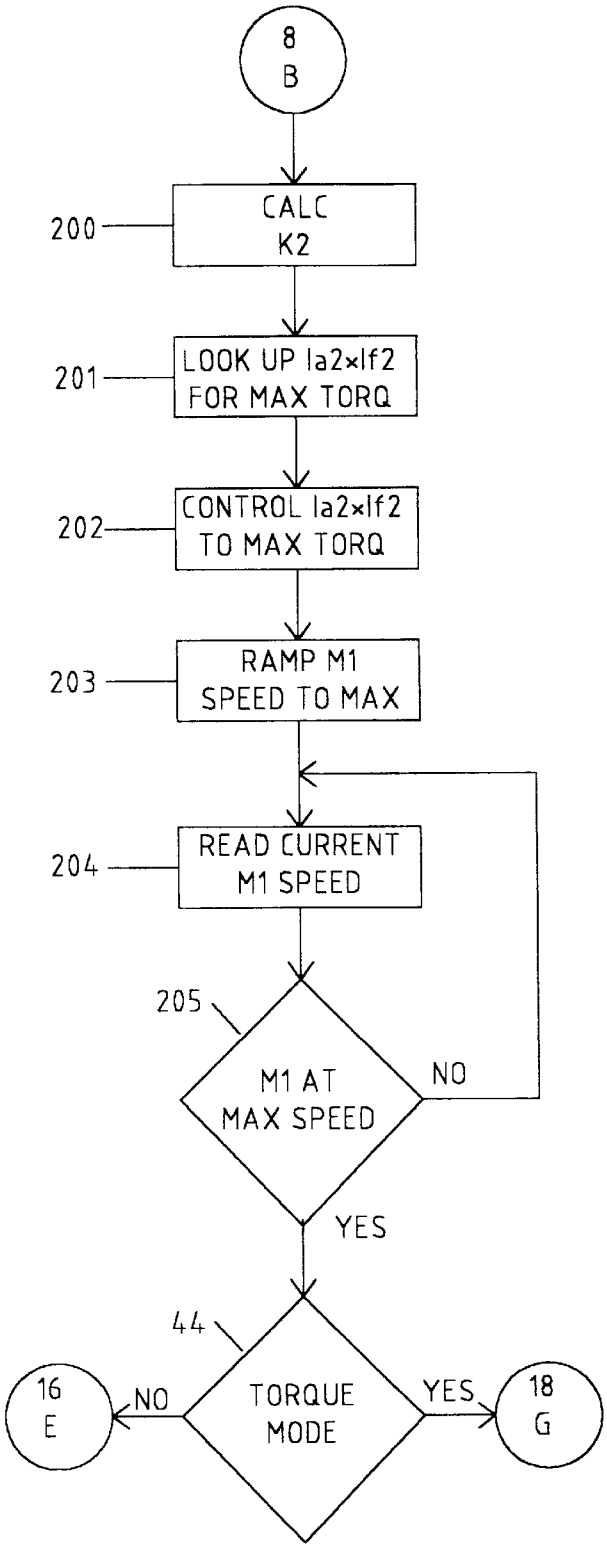
Figure 10E:
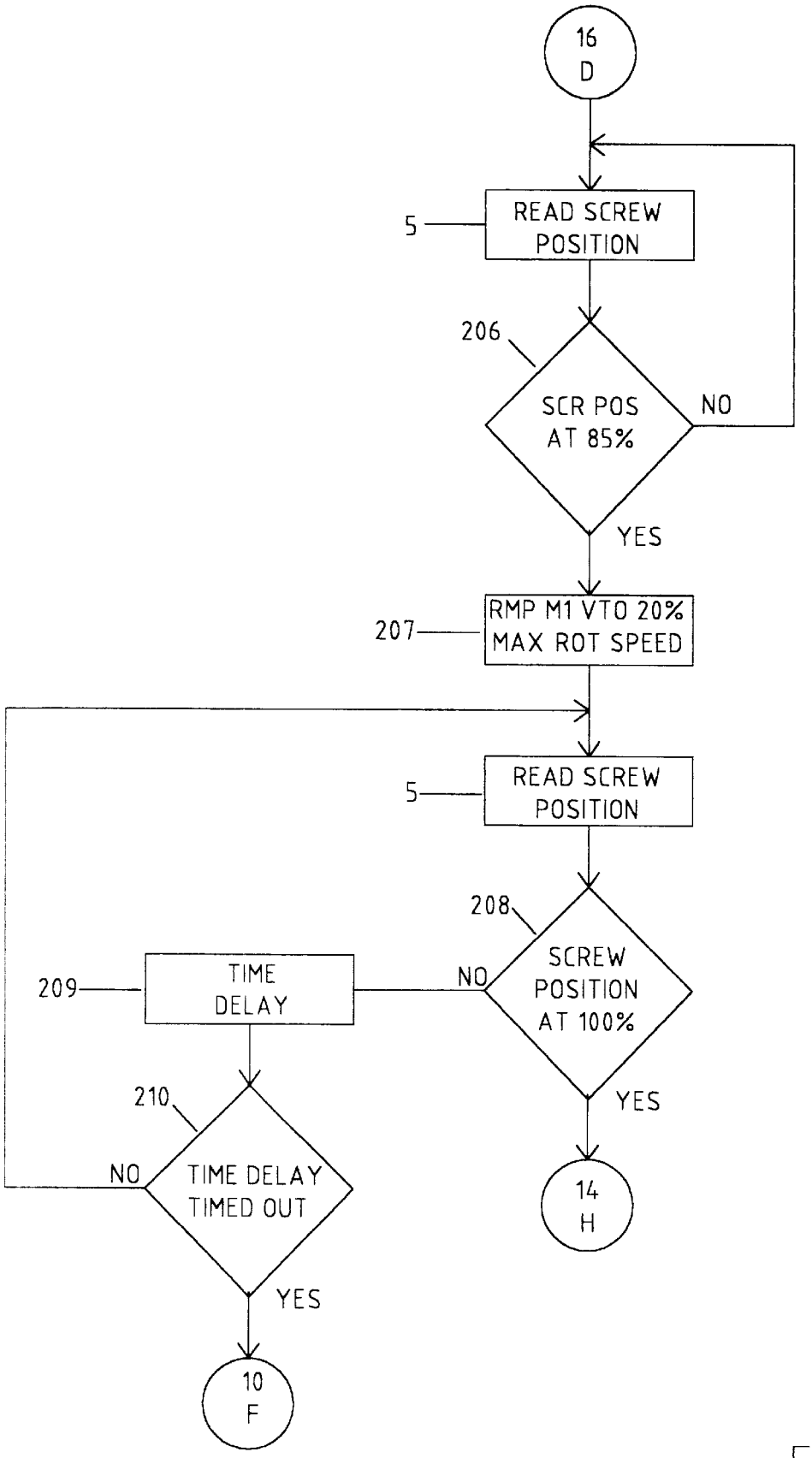
Figure 10F:
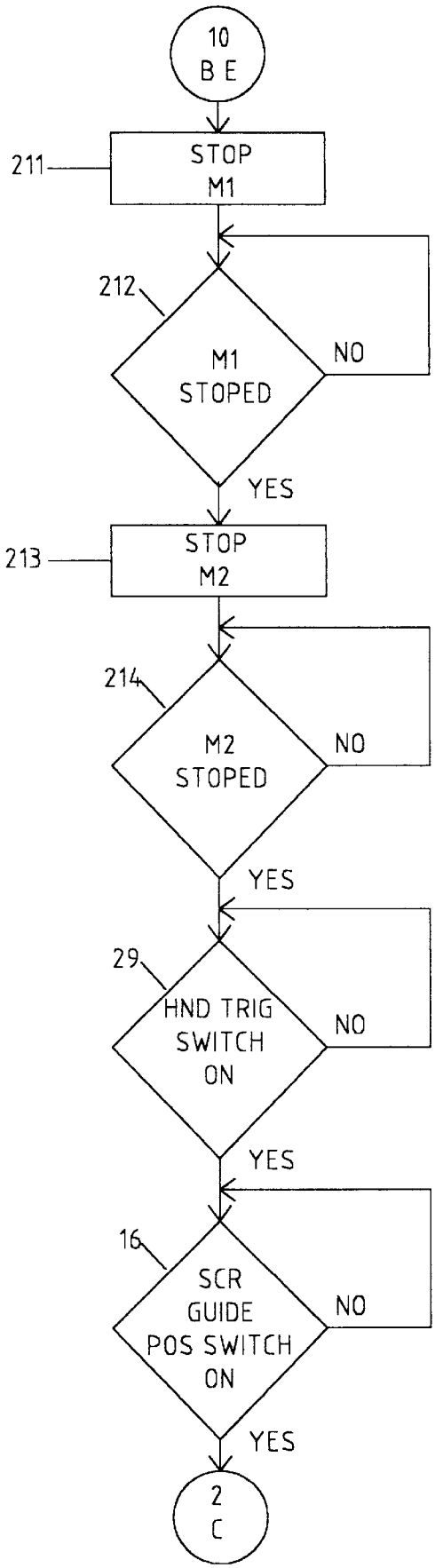
Figure 10G:
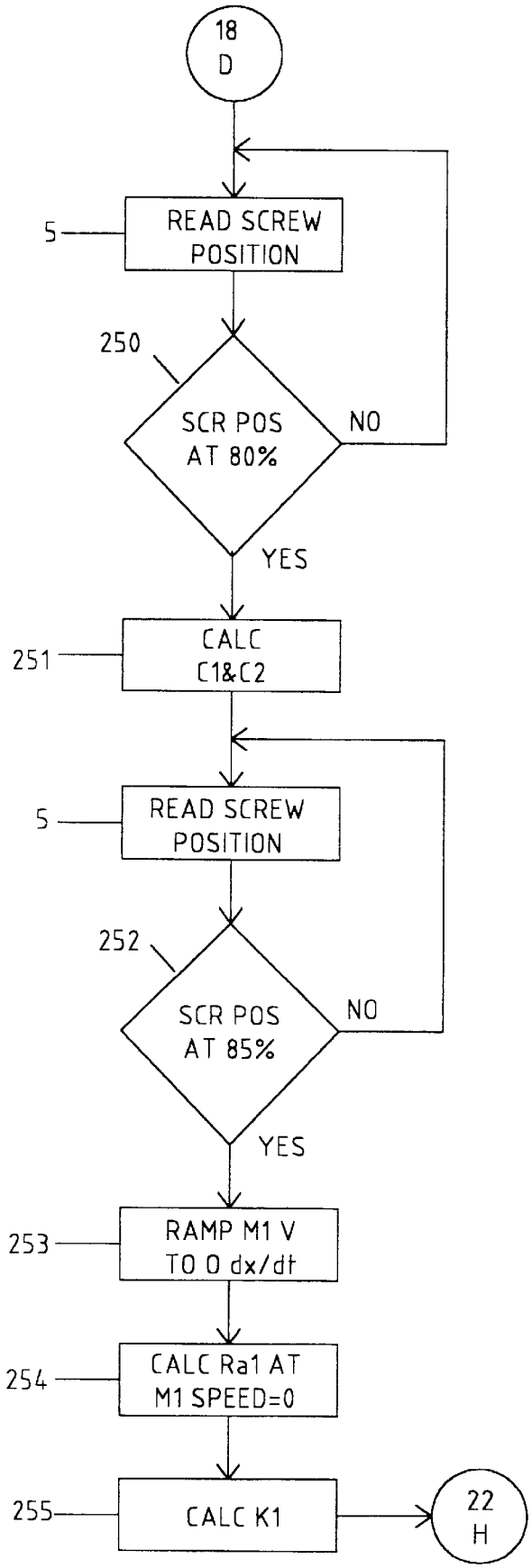
Figure 10H:
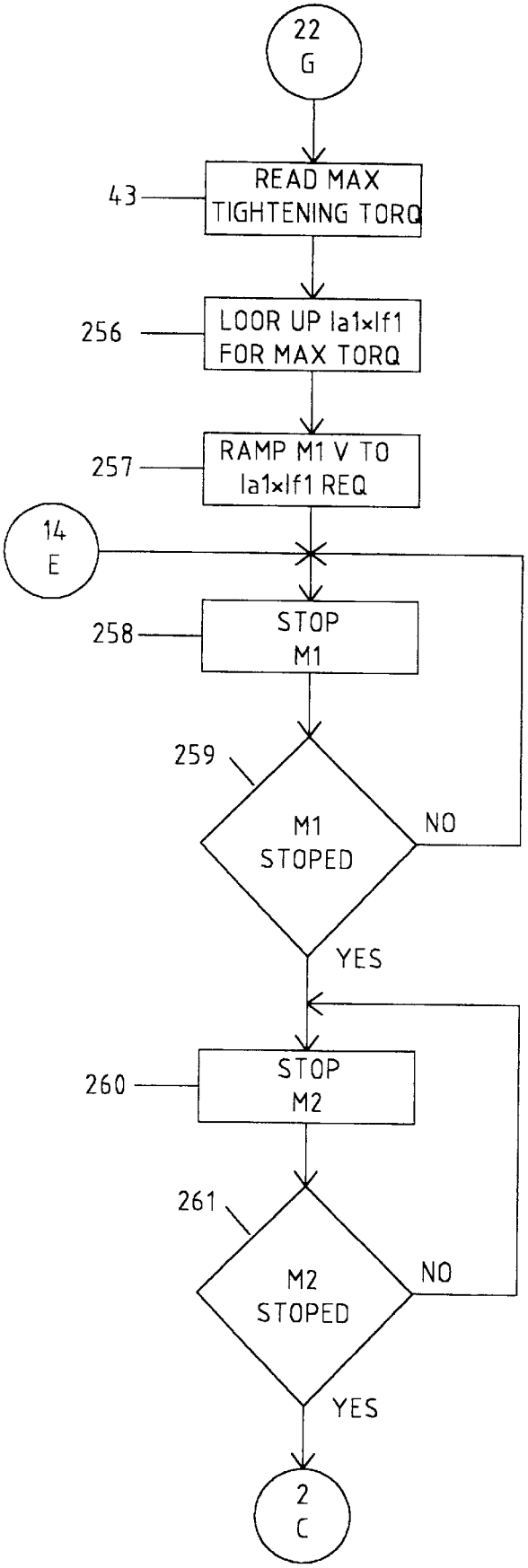

Motors M1 and M2 are then stopped in the sequence 258/261. The cycle then goes to entry point 2 (FIG. 10C).

At 129, the position of the screwdriver bit 7 is determined; if the screwdriver bit 7 is not retracted, the M2 retraction mode is initiated at 130; if the retraction mode is not completed within a time limit, M2 is stopped at 132 and a fault indication appears at 46. If the retraction mode is successful, then the retraction mode is stopped at 133. At 134, the magnetic clutch 20 engages the tape drive gears 21 to the first motor M1. At 134, the screw tape drive mode is initiated, and the screw position switch 20 determines that the carrier tape 33 is moving and that another screw 15 is loaded into position within a time limit set by time delay 136. If time delay 136 times out, the M1 tape drive mode is stopped at 137 and an empty indication appears at 45. If the screw positioning operation has been successful, the tape drive mode is stopped at 138 and the magnetic clutch 20 is released at 139. The system is now ready for another cycle, which can be initiated by either releasing the hand trigger switch 29 and sliding the screw driving device D to another location without releasing the actuator 17 and thus the front safety switch 16, or by lifting the device D away from the work surface and placing it at another location without releasing the hand trigger switch 29.

It is readily understood from the foregoing that the screw driving device D of the present invention provides a fully automated electric screwdriver which, for instance, eliminates the need for any manual translational displacement of the screwdriver bit until it engages the screw.

I claim:

1. A screw driving device for driving screws into work pieces, comprising housing means, magazine means adapted to carry a plurality of screws, a screwdriver bit in said housing means, first motorized displacement means for positioning one of the screws opposite said screwdriver bit in an operational position of the screw, second motorized displacement means for rotatably driving said screwdriver bit, third motorized displacement means for translationally displacing said screwdriver bit between a screw driving position and at least one retracted position and coaxially to the screw in said operational position, control switch means adapted when actuated to cause, in synchronization, said first displacement means to bring a screw to said operational position, said third displacement means to displace said screwdriver bit into engagement with the screw, and said second displacement means to rotate said screwdriver bit and thus the screw while said third displacement means progressively advances the rotating screw such that it engages a work piece.

2. A screw driving device as defined in claim 1, further comprising main control means for automatically and with synchronism operate said first, second and third displacement means upon actuation of said control switch means, position determining means for providing to said main control means a relative position of said screwdriver bit with respect to said screw in said operational position.

3. A screw driving device as defined in claim 2, wherein said position determining means comprise screw penetration control means for allowing said screw in said operational position to be inserted in the work piece at a predetermined depth.

4. A screw driving device as defined in claim 3, wherein said position determining means comprise a potentiometer means.

5. A screw driving device as defined in claim 2, wherein said second displacement means comprise motor means provided with torque control means adapted to stop rotation of said screwdriver bit upon sufficient exterior resistance being applied thereon.

6. A screw driving device as defined in claim 2, wherein said first and second displacement means comprise first motor means provided with torque control means adapted to stop rotation of said screwdriver bit upon sufficient exterior resistance being applied thereon, said first motor means being also adapted not to actuate said first displacement means when said screwdriver bit is engaged to the screw in said operational position for preventing said first displacement means from displacing this screw.

7. A screw driving device as defined in claim 6, wherein said first motor means is disengaged from said first displacement means by magnetic clutch means when said clutch means is actuated by said main control means.

8. A screw driving device as defined in claim 6, wherein said first motor means is adapted to rotatably drive gear means disposed around said screwdriver bit and adapted to cause a simultaneous rotation of said screwdriver bit while allowing said screwdriver bit to slide through said gear means.

9. A screw driving device as defined in claim 2, wherein the plurality of screws are detachably carried on a screw carrier tape means, said first displacement means comprising a pair of rotatable roller means adapted to drive said screw carrier tape means extending therebetween, tape switch means for selectively operating or stopping said roller means, said screw carrier tape means defining index notch means, whereby when actuated, said roller means displace said carrier tape means to bring the screw in said operational position and are stopped by signal means resulting from said tape switch means being actuated by said notch means thereby ensuring that the screws are fed one-by-one to said operational position.

10. A screw driving device as defined in claim 2, further comprising a bobbin comprising spindle means and screw carrier tape means, the plurality of screws being detachably mounted to said carrier tape means, said carrier tape means being adapted to be driven by said first displacement means, said bobbin including the screws and said carrier tape means being removably installable in said magazine means, each screw extending substantially perpendicularly to a plane of a respective portion of said carrier tape means where said screw is attached, said screws extending in a substantially parallel and successive manner along said carrier tape means with said carrier tape means being spirally wound around said spindle means with the screw in said operational position being adapted to be detached from said carrier tape means by said screwdriver bit as the latter extends through said carrier tape means by way of said third displacement means.

11. A screw driving device as defined in claim 2, wherein said third displacement means comprise motor means, pinion means and rack means in meshed engagement with said pinion means, said screwdriver bit being adapted to be secured to said rack means, said motor means being adapted to rotatably drive said pinion means which translationally displaces said rack means and thus said screwdriver bit.

12. A screw driving device as defined in claim 2, wherein said screwdriver bit is provided with magnetic means for holding the screw in said operational position to said screwdriver bit at least until this screw is sufficiently engaged to the work piece; and wherein said screwdriver bit is removable from said housing means such that said screw driving device can be used to drive screws having various head sockets.

13. A screw driving device as defined in claim 1, wherein there is further provided a replaceable bobbin comprising carrier tape means onto which are detachably mounted said plurality of screws, said screws being adapted to be driven by the screw driving device and to be detached thereby from said carrier tape means, said bobbin being removably installable in the screw driving device and including a spindle, each screw extending substantially perpendicularly to a plane of a respective portion of said carrier tape means where said screw is attached, said screws extending in a substantially parallel and successive manner along said carrier tape means with said carrier tape means being wound around said spindle.

14. A screw driving device as defined in claim 13, wherein said carrier tape means is substantially spirally wound substantially coplanarly around said spindle.

15. A screw driving device as defined in claim 14, wherein said screws comprise screw heads and are attached to said carrier tape means at said screw heads with at least one of said screw heads and said carrier tape means abutting a flange of said bobbin.

16. A screw driving device as defined in claim 2, wherein force control means are provided for controlling a seating force of said screwdriver bit on the screw in said operational position.

17. A screw driving device as defined in claim 2, wherein screw guide means extend around the screw in said operative position substantially right up to a distal end of said housing means adapted to abut the work piece; and wherein said control switch means comprise trigger means located at a handle of said housing means and adapted to be manually depressed by a user and work piece switch means extending outwardly from said distal end and being retractable in said housing when said housing means is brought into abutment with the work piece.

18. A method for driving screws into work pieces using a screw driving device having a housing containing a translationally and rotatably displaceable screwdriver bit and a plurality of screws, comprising the step of:

(a) with said screwdriver bit being sufficiently retracted, feeding one of the screws to a location opposite said screwdriver bit such that it extends substantially coaxially therewith;

(b) displacing translationally said screwdriver bit towards the screw and into engagement therewith; and (c) rotating said screwdriver bit and the screw while translationally advancing said screwdriver bit towards the work piece such that the screw engages the work piece;

wherein above steps (a), (b) and (c) take place automatically and in a synchronized manner, and wherein in step (c), a seating force applied by said screwdriver bit on the screw is controlled, a penetration of the screw in the work piece is controlled for obtaining a desired final screw depth in the work piece, and an seating torque on the screw is controlled for controlling a final screw head seating torque.

19. A screw driving device for driving screws into work pieces, comprising housing means, screw carrier tape means, a plurality of screws detachably mounted on said screw carrier tape means, said screw carrier tape means defining index notch means, a screwdriver bit in said housing means which is rotatable for driving the screws one-by-one into work pieces, displacement means for positioning one of the screws opposite said screwdriver bit in an operational position of the screw such that said screwdriver bit can then be engaged to the screw, said displacement means comprising motorized rotatable roller means adapted to drive said screw carrier tape means and switch means for selectively operating or stopping said roller means, whereby said roller means displace said carrier tape means to bring the screw in said operational position and are stopped by signal means resulting from said switch means being actuated by said notch means.

20. A screw driving device as defined in claim 19, wherein said roller means are located downstream of said operational position such as to receive therebetween a section of said carrier means which is empty of screws.

* * * * *